United States Patent [19]

Hutchison

[11] 4,323,953

[45] Apr. 6, 1982

[54] FLOODLIGHT

[75] Inventor: Mark A. Hutchison, Crawfordsville, Ind.

[73] Assignee: National Service Industries, Inc., Crawfordsville, Ind.

[21] Appl. No.: 151,262

[22] Filed: May 19, 1980

[51] Int. Cl.[3] ..... H01R 33/00

[52] U.S. Cl. ..... 362/226; 362/220; 362/223; 362/269; 362/282; 362/362; 362/374; 362/375

[58] Field of Search ..... 362/226, 220, 223, 269, 362/282, 362, 374, 375

[56] References Cited

U.S. PATENT DOCUMENTS 3,686,495 8/1972 Medley ..... 362/223

*Primary Examiner*—Stephen J. Lechert, Jr.

*Attorney, Agent, or Firm*—Richard D. Emch

[57] ABSTRACT

An improved flood lighting fixture for a horizontally mounted HID lamp is disclosed. Relamping is accomplished by removing an access cover to expose an access opening, pivoting a reflector to a relamping position, exchanging the lamp through the access opening, pivoting the reflector back to its normal position and replacing the access cover.

5 Claims, 5 Drawing Figures

FLOODLIGHT

BACKGROUND OF THE INVENTION

This invention relates to luminaires and more particularly to an improved flood lighting fixture for mounting a horizontal high pressure discharge lamp.

Lighting fixtures using high intensity discharge (HID) lamps are used for many applications. For example, flood lighting fixtures using HID lamps are commonly used for illuminating buildings, parking lots, roadways and the like. One type of flood lighting fixture is in the general shape of a rectangular box which may be mounted, for example, on a pole or on a wall. A reflector is mounted within the box and the lamp in turn is mounted between the reflector and a lense. The box also mounts a ballast and starting circuit for operating the lamp. With certain designs, it has been difficult to design the lighting fixture for ease in relamping. It is necessary to at least partially disassemble the lighting fixture in order to replace the lamp. This has been accomplished in the past, for example, by removing the lense. However, the lighting fixture also must be constructed to withstand rain, wind, dust and other adverse environmental conditions to which it is subjected during operation. Therefore, when the lense is removed and subsequently replaced during relamping, it is necessary to maintain a seal between the lense and the fixture housing. It also should be noted that in many applications, such as in parking lot lighting, the flood lighting fixture is mounted on a pole. Therefore, maintenance personnel must relamp the fixture while standing on a ladder, scaffolding or a cherry picker.

SUMMARY OF THE INVENTION

According to the present invention, an improved flood lighting fixture is provided for high intensity discharge lamps and particularly for HID lamps which require a horizontal mounting. The lighting fixture design facilitates relamping. The lighting fixture generally comprises a rectangular housing having a horizontally oriented retangular lense on one side. A reflector is mounted behind the lense and the HID lamp is mounted in a socket attached to the reflector. A sealed access cover is provided in the top of the fixture housing. During relamping, maintenance personnel remove the access cover and release the reflector top, allowing the reflector to pivot about a horizontal hinge located adjacent the lower edge of the lense. The reflector pivots back sufficiently to allow the maintenance man to insert his hand into the reflector, remove the lamp from its socket and withdraw the lamp through the access opening. A new lamp then is inserted into the socket and the reflector is pivoted back to its normal operating position. Finally, the access cover is replaced to close and seal the access opening. Through this design of a flood lighting fixture, relamping is accomplished without removing the lense from the fixture housing and without disassembling the fixture housing other than removing the access cover.

Accordingly, it is an object of the invention to provide an improved flood lighting fixture which facilitates relamping.

Another object of the invention is to provide an improved flood lighting fixture for horizontally mounted HID lamps which facilitates relamping.

Other objects and advantages of the invention will become apparent from the following detailed description, with reference being made to the accompanying drawings.

DESCRIPTION OF THE PREFERRED EMBODIMENT

Figure 1:
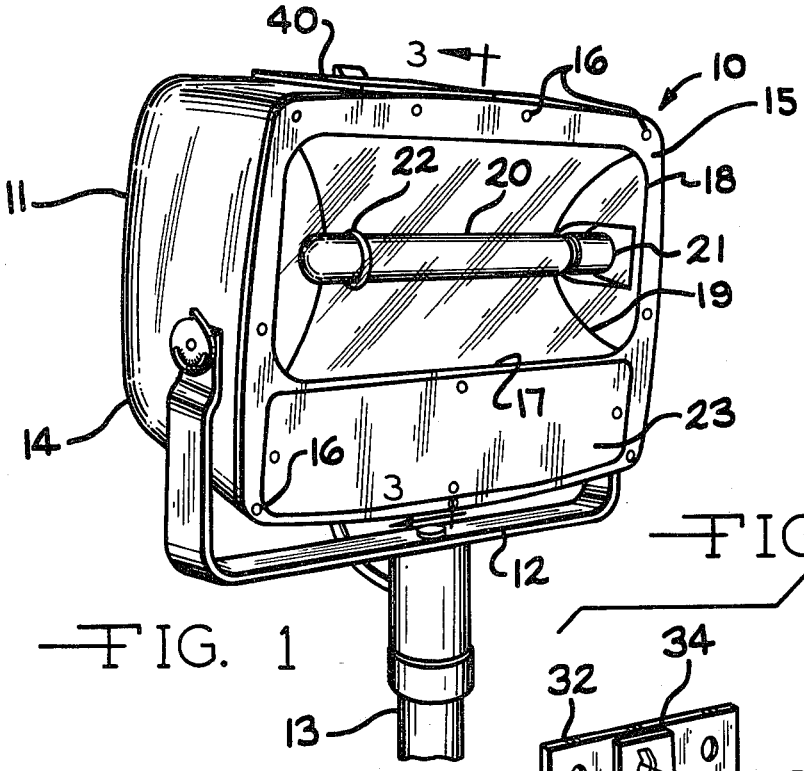
FIG. 1 is a front perspective view of a flood lighting fixture constructed in accordance with the present invention.

Turning now to the drawings and particularly to FIG. 1, a flood lighting fixture 10 is illustrated in accordance with the present invention. The fixture 10 is generally in the form of a horizontally mounted rectangular housing 11 which is supported by a bracket 12 mounted on a pole 13. Of course, other types of fixture mountings may be provided. The housing generally comprises a cast section 14 which is generally pan shaped and a side cover 15. The side cover 15 is attached to the cast section 14 by a plurality of screws 16. The side cover 15 defines an opening 17 which is closed by a light transmitting refractor or lense 18. A reflector 19 is mounted behind the lense 18 for directing light from a lamp 20 through the lense 18. The lamp 20 is illustrated in a horizontal mounting position and may be, for example, a 1,000 watt high pressure sodium lamp. The lamp 20 is mounted in a socket 21 which in turn is mounted on the reflector 19. The lamp 20 also is retained with a lamp supporting clip 22 which is mounted on the reflector 19.

In addition to the reflector 19 and the lamp 20, the housing 11 encloses the necessary electrical components for operating the lamp 20, including a starting circuit for igniting the lamp 20 and a ballast circuit for limiting current flow to the lamp 20. A power door 23 may be removeably attached to the housing side cover 15 to provide access to the electrical components mounted within the housing 11.

Figure 4:
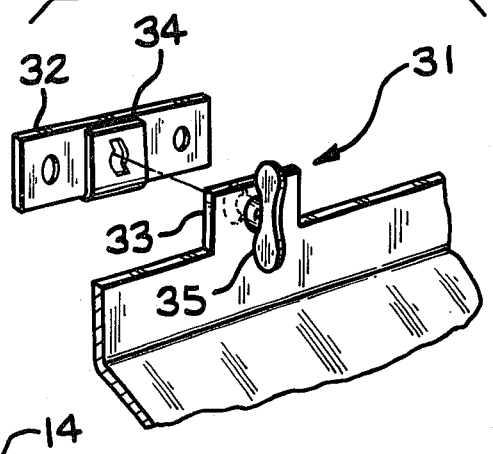
FIG. 4 is an enlarged fragmentary perspective view of a latch for releasably holding the reflector in its normal operating position within the flood lighting fixture of the present invention.
Figure 2:
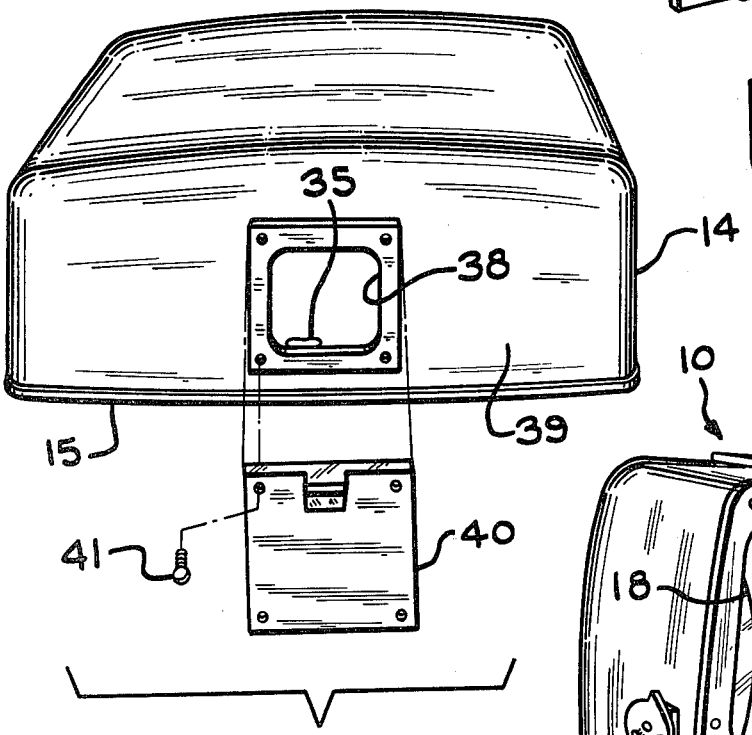
FIG. 2 is an exploded top perspective view of the flood lighting fixture of FIG. 1, showing the access cover removed.
Figure 3:
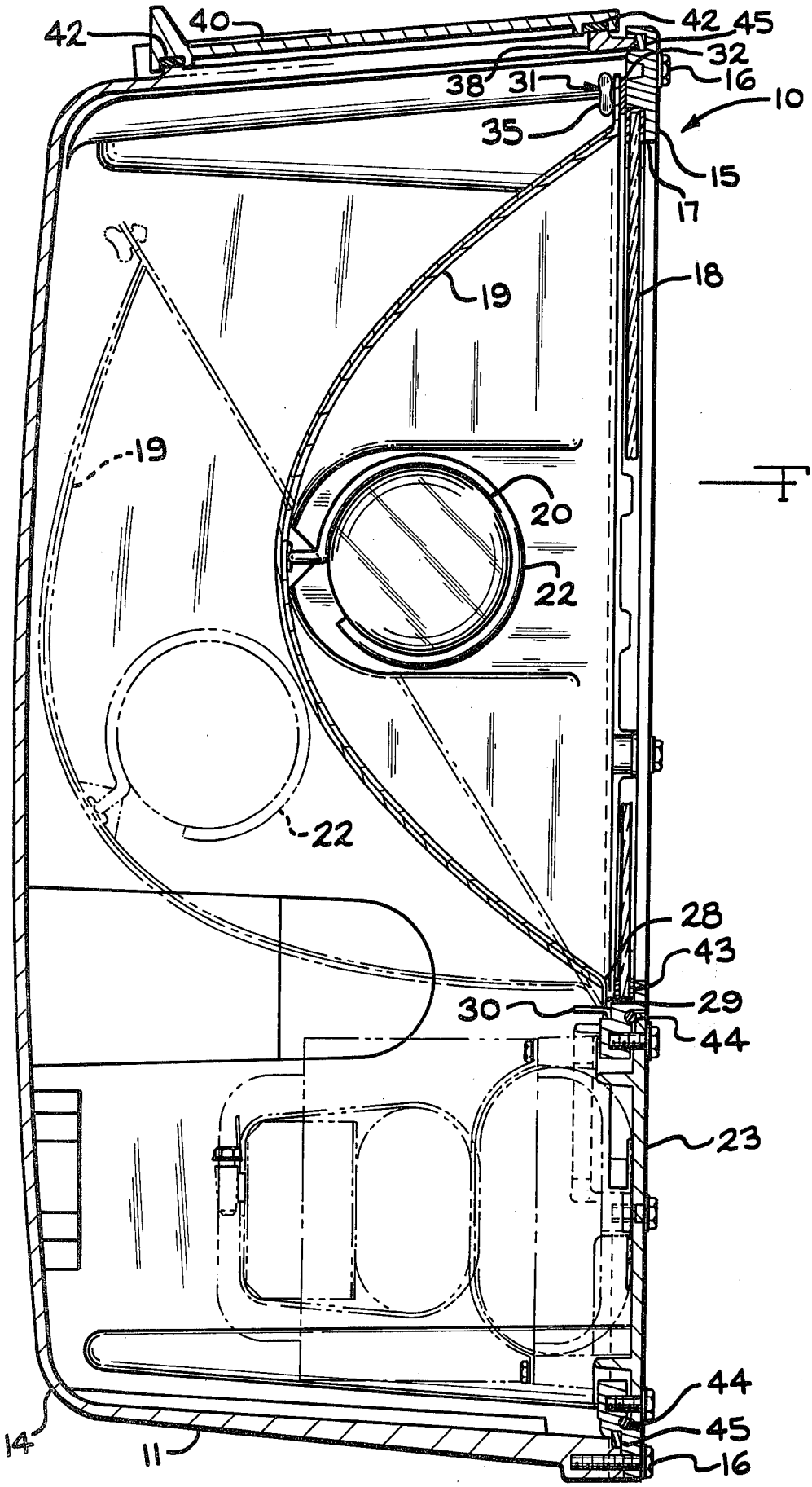
FIG. 3 is a cross sectional view of the flood lighting fixture of the present invention taken along line 3—3 of FIG. 1.

Turning now to FIGS. 2, 3 and 4, details are shown of the internal construction of the fixture 10. The reflector 19 has a lower edge 28 which is connected through a hinge construction to the housing 11. The hinge may comprise, for example, a series of spaced tabs 29 which fit into corresponding slots formed in a bracket 30 attached to the side cover 15. The hinge defined by the tabs 29 which engage the bracket 30 permit the reflector 19 to pivot between a normal operating position, as illustrated by the solid lines showing the reflector 19 in FIG. 3, and a relamping position as illustrated by the broken lines showing the reflector 19 in FIG. 3.

A latch 31 is provided for releasably holding the reflector 19 in its normal operating position. The latch 31 is illustrated in an enlarged fragmentary perspective view in FIG. 4. The latch 31 includes a bracket 32 mounted on the housing side cover 15 above the lense 18 and a bracket 33 mounted on the reflector 19. A quarter turn clip-on receptacle 34 is attached to the bracket 32 and a quarter turn wing head lock 35 passes through the bracket 33. When the reflector 19 is locked in its normal operating position, the lock 35 engages the receptacle 34 to prevent rotational movement of the reflector 19. In order to relamp the fixture 10, the lock 35 is merely rotated by one quarter turn to allow the lock 35 to slide clear of the receptacle 34.

Turning now to FIGS. 2 and 3, it will be noted that an access opening 38 is provided in a top portion 39 of the cast housing section 14. The latch 31 is located immediately inside the access opening 38. During normal operation of the flood lighting fixture 10, a cover 40 is mounted over the access opening 38 and is held in place by a plurality of screws 41. A suitable seal 42 is provided between the cover 40 and housing top 39 to extend around the access opening. It should be noted that a similar seal 43 is provided between the lense 18 and the housing side cover 15, a seal 44 is provided between the power door 23 and the housing side cover 15 and a seal 45 is provided between the side cover 15 and the cast housing section 14 so as to permit use of the lighting fixture 10 in adverse environments, such as outdoors.

Figure 5:
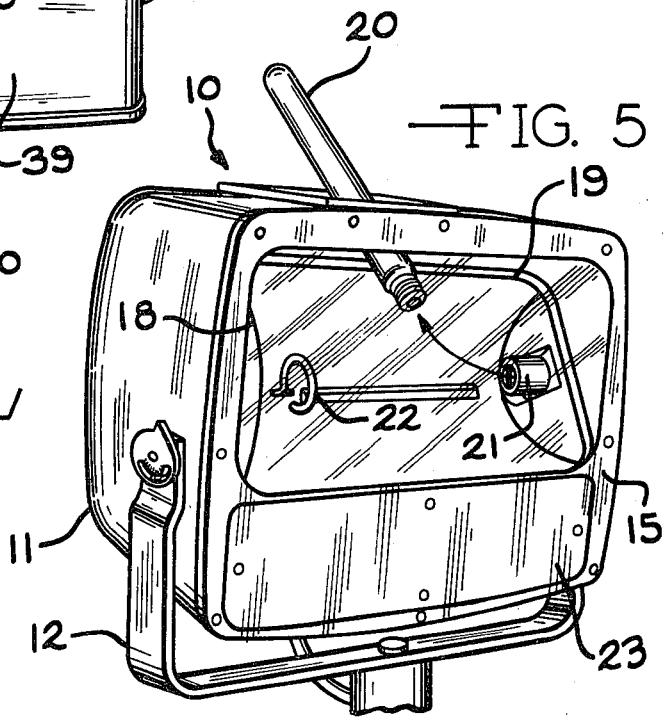
FIG. 5 is a front perspective view of the lighting fixture of FIG. 1 during relamping and showing a lamp being removed.

Turning now to FIGS. 2, 3, and 5, the method for relamping the flood lighting fixture 10 is illustrated. When relamping becomes necessary the access door 40 is removed by a maintenance person removing the screws 41. The maintenance person then reaches through the access opening 38 and rotates the lock 35 by one quarter turn to disengage the latch 31. When the latch 31 is disengaged, the reflector 19 is pivoted to the relamping position illustrated in FIGS. 3 and 5. The lamp 20 then is removed from the socket 21 and the supporting clip 22 and a new lamp is inserted in its place. The maintenance person then returns the reflector 19 to its normal operating position and rotates the lock 35 to reengage the latch 31. Finally, the access cover 40 is replaced and the relamping operation is completed.

Although it is preferable that the lamp socket be mounted on the reflector 19, it should be appreciated that the lamp socket 21 may be attached to the cast housing section 14. The end of the reflector 19 then is provided with a relief area which allows the reflector 19 to pivot about the fixed socket. In this arrangement, the reflector 19 again is pivoted to allow access to the lamp for relamping without the need for removing the lense or the housing side cover 15. It will be appreciated that various other changes and modifications may be made in the above described preferred embodiment of the invention without departing from the spirit and the scope of the following claims.

I claim:

1. A lighting fixture comprising an enclosed housing including a side, said housing side defining an opening, a light transmitting lense enclosing said side opening, a reflector, hinge means connecting said reflector to said housing adjacent said lense to pivot said reflector relative to said housing between a normal operating position and a relamping position, latch means spaced from said hinge means for releasably holding said reflector in said normal position, a lamp socket mounted on said reflector for supporting a lamp between said reflector and said lense, and means in said housing for providing access to said latch means for releasing and pivoting said reflector and said lamp socket to said relamping position and for providing access to a lamp supported in said socket when said reflector is pivoted to said relamping position.

2. The lighting fixture of claim 1, wherein said lense has a lower edge, and wherein said hinge means connects said reflector to said housing adjacent said lower lense edge.

3. The lighting fixture of claims 1 or 2, wherein said housing further includes a top, and wherein said access means includes an access opening in said housing top, cover means for sealing said access opening, and means for removably attaching said cover means to said housing top.

4. The lighting fixture of claims 1, 2 or 3, wherein said socket is mounted on said reflector to support a lamp in a horizontal orientation.

5. A lighting fixture comprising an enclosed housing including a side, said housing side defining an opening, a light transmitting lense enclosing said side opening, a reflector, hinge means connecting said reflector to said housing adjacent said lense to pivot said reflector relative to said housing between a normal operating position and a relamping position, latch means spaced from said hinge means for releasably holding said reflector in said normal position, a lamp socket mounted in said housing for supporting a lamp between said reflector and said lense, and means in said housing for providing access to said latch means for releasing and pivoting said reflector to said relamping position and for providing access to a lamp supported in said socket when said reflector is pivoted to said relamping position.

* * * * *